US006578674B2

(12) United States Patent
Doran

(10) Patent No.: US 6,578,674 B2
(45) Date of Patent: Jun. 17, 2003

(54) CONVERTER ARRANGEMENT FOR MODULAR MOTOR

(76) Inventor: Paul J. Doran, 1071 Princeton Dr., Yardley, PA (US) 19067

( * ) Notice: Subject to any disclaimer, the term of this patent is extended or adjusted under 35 U.S.C. 154(b) by 0 days.

(21) Appl. No.: 09/974,466

(22) Filed: Oct. 10, 2001

(65) Prior Publication Data

US 2002/0011384 A1 Jan. 31, 2002

Related U.S. Application Data

(63) Continuation of application No. 09/490,084, filed on Jan. 24, 2000, now Pat. No. 6,315,080.

(51) Int. Cl.[7] ..... B66B 11/00

(52) U.S. Cl. ..... 187/277; 187/250; 187/289

(58) Field of Search ..... 187/289, 250, 187/270, 277, 411, 413, 414; 310/89, 91, 112, 113; 403/13, 350, 286, 287, 322, 337; 248/637–639, 645, 646, 650, 652, 666, 667, 674–681, 141.1–141.7

(56) References Cited

U.S. PATENT DOCUMENTS

| | | | | | |
|---|---|---|---|---|---|
| 1,517,761 | A | | 12/1924 | Sorensen et al. | 403/334 |
| 2,402,743 | A | * | 6/1946 | Firth | 29/892 |
| 3,883,759 | A | | 5/1975 | Mierendorf | 310/112 |
| 3,888,093 | A | * | 6/1975 | Downey | 464/137 |
| 4,000,793 | A | * | 1/1977 | Chung | 192/105 A |
| 4,120,388 | A | * | 10/1978 | Nisley | 192/105 A |
| 4,355,785 | A | | 10/1982 | Tosato et al. | 187/20 |
| 4,365,964 | A | * | 12/1982 | Krome, Jr. | 474/28 |
| 4,494,889 | A | * | 1/1985 | Thompson | 403/16 |
| 4,500,226 | A | | 2/1985 | Romand-Monnier et al. | 403/13 |
| 4,525,095 | A | * | 6/1985 | Lamb et al. | 403/16 |
| 4,578,608 | A | * | 3/1986 | Mech et al. | 310/112 |
| 4,606,671 | A | * | 8/1986 | Rasmussen | 403/359 |
| 5,002,157 | A | * | 3/1991 | Heikkinen | 187/254 |
| 5,148,893 | A | | 9/1992 | Vertesy et al. | 187/20 |
| 5,299,880 | A | * | 4/1994 | Bouchard | 403/24 |
| 5,433,294 | A | * | 7/1995 | Walker | 187/254 |
| 5,449,153 | A | * | 9/1995 | Catalano et al. | 267/141.2 |
| 5,772,176 | A | * | 6/1998 | Keck et al. | 248/638 |
| 5,850,115 | A | * | 12/1998 | Grosskopf | 310/67 R |
| 5,939,807 | A | * | 8/1999 | Patyk et al. | 310/89 |
| 6,202,507 | B1 | * | 3/2001 | Phillips | 74/606 R |
| 6,315,080 | B1 | * | 11/2001 | Doran | 187/289 |
| 6,328,274 | B1 | * | 12/2001 | Hayashi | 248/606 |
| 6,378,832 | B1 | * | 4/2002 | Li et al. | 248/635 |
| 6,386,844 | B1 | * | 5/2002 | Chen et al. | 415/214.1 |
| 6,398,521 | B1 | * | 6/2002 | Yorulmazoglu | 403/298 |
| 2001/0026761 | A1 | * | 5/2001 | Repple et al. | 417/292 |

* cited by examiner

*Primary Examiner*—Jonathan Salata
(74) *Attorney, Agent, or Firm*—Duane Morris LLP

(57) ABSTRACT

A bracket assembly and method for coupling a motor to a hoist machine comprising an adapter plate for coupling to a motor face and sized to cover the face of the motor and accommodate an existing motor register on the hoist machine, a drum flange member coupled to the hoist machine to reduce vibrations, the drum flange member having a central cavity for receiving the motor shaft, a second flange member having a bushing sized to the motor shaft, and a coupling plate positioned between the first and second flange members, the coupling plate made of a resilient material such as a plastic. Each of the first and second flange members and coupling plates have hole portions radially positioned and in alignment with one another, the drum flange having holes formed therein for accommodating a connecting rod such as a bolt to securely fasten the drum flange to the drum brake of the hoist machine.

20 Claims, 9 Drawing Sheets

CONVERTER ARRANGEMENT FOR MODULAR MOTOR

This application is a continuation of commonly assigned, application Ser. No. 09/490,084 entitled CONVERTER FOR A MODULAR MOTOR TO COUPLE TO A HOIST MACHINE filed Jan. 24, 2000, now U.S. Pat. No. 6,315,080 B1.

FIELD OF THE INVENTION

The invention relates generally to electric motors and more particularly to a coupling arrangement for coupling an electric motor to a hoist machine.

BACKGROUND OF THE INVENTION

Industrial application of motor assemblies often require that the motor be coupled to a hoist machine or overhung machine due to space limitations, industrial standards and requirements (NEMA) and the like. Such motor assemblies and applications are prevalent in the elevator industry, for example.

Existing integral overhung style elevator hoist machines were designed originally with motors having single bearings on the back end and supported in the front end by being bolted to the hoist machine. Typically, the overhung hoist machine has a sleeve bearing at the motor end with internal clearances typically of 0.005 to 0.010 inch, which is quite large. The internal clearances (i.e. movement of the shaft in an up/down fashion) of single bearing motors are compatible with these machines. However, advances in motor technology have caused the production of single bearing motors to be phased out.

New style motors such as C and D face motors are being produced and are now available from major manufacturers. These motors are consistent with NEMA standards. These new motors, which have two ball bearings, have caused the single bearing motors to become technically obsolete. Thus, the single bearing motors are no longer readily available. The new motors are manufactured with higher efficiencies which create closer tolerances and are made with ball bearings on each end in order to maintain these tolerances. Thus, the new style motors are two bearing motors, where the ball bearings used have approximately 6 microns ($\mu$m) of internal clearance when rigidly coupled to a sleeve bearing hoist machine. However, the hoist machine has over one hundred times the internal clearances of the new style motors. This causes problems when coupling the new motors to the existing hoist machines. Because the hoist machine has a much greater size relative to the internal clearances of the new style, two ball bearing motors, all of the axial and radial load is supported by the motor rather than the hoist as originally intended. Thus, if the hoist machine, which originally supported this, and has the big loading bearings therein, that bearing is rendered useless due to the closeness of the bearing in the shaft end of the motor. This results in premature bearing failure in the motor and causes end-thrusting problems associated with the encoder that is to be mounted onto the end of the motor.

In view of the above, it is highly desirable to obtain a coupling arrangement for mounting such a two bearing motor onto an existing integral overhung style hoist machine without the need for special tools or complex alignment steps and which takes into consideration proper alignment, radial overloading and end-thrusting problems that are caused when the new style motors are fitted to an older style or larger tolerance machine.

SUMMARY OF THE INVENTION

One aspect of the present invention is an adapter plate for mounting a motor housing to a hoist machine housing. The adapter plate has a central opening for receiving a drive shaft of the motor, an inner surface adapted for engaging a front surface of the motor, and an outer surface opposite the inner surface adapted for engaging a front surface of the hoist machine. The adapter plate includes a plurality of apertures for receiving fasteners for fastening to said front surface of the motor and the front surface of the hoist machine.

Another aspect of the invention is a method for mounting a motor housing to a hoist machine housing. An adapter plate is provided, having a central opening for receiving a drive shaft of the motor, an inner surface adapted for engaging a front surface of the motor; and an outer surface opposite the inner surface adapted for engaging a front surface of the hoist machine. A plurality of apertures are formed in the adapter plate. The adapter plate is fastened to the front surface of the motor and to the front surface of the hoist machine via the plurality of apertures.

DETAILED DESCRIPTION OF THE INVENTION

Figure 1:
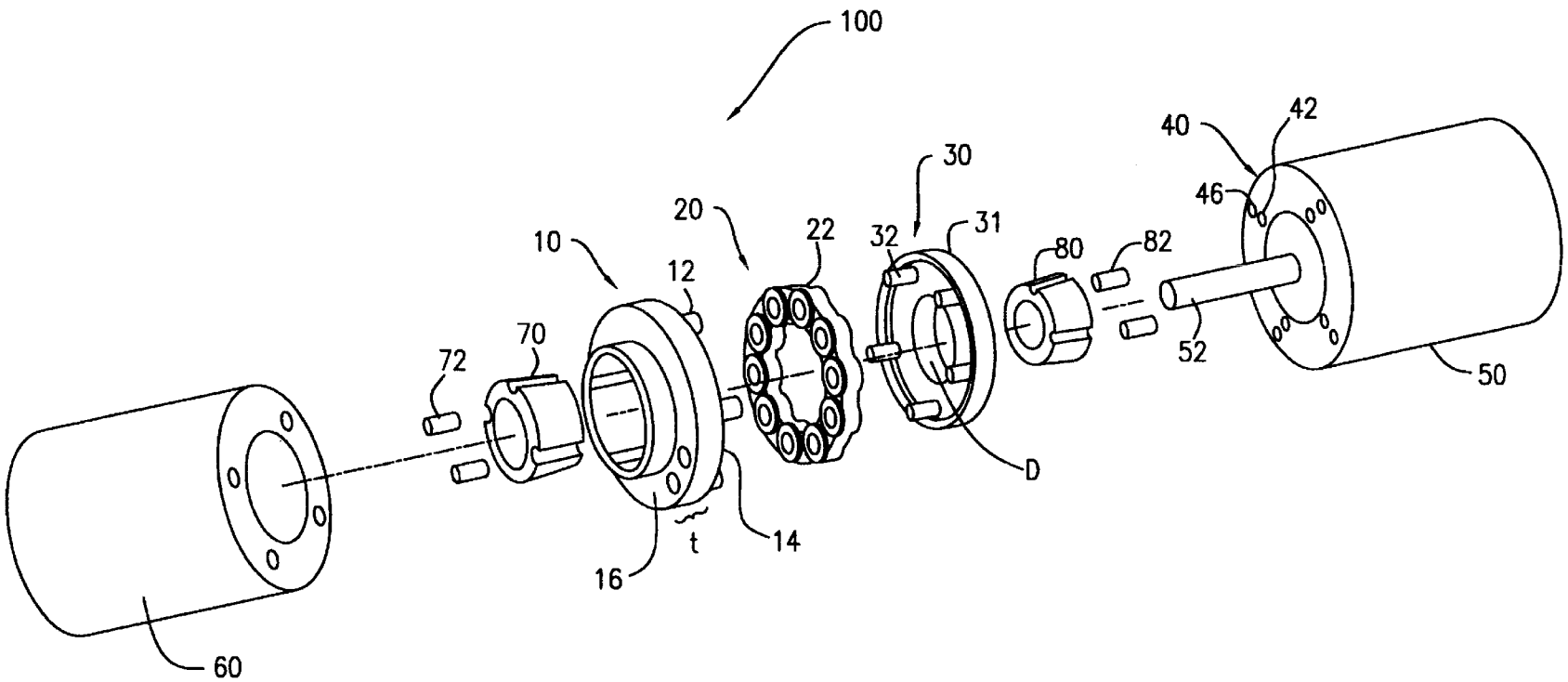
FIG. 1 illustrates an exploded view of a converter bracket assembly for coupling a two bearing motor onto an integral overhung hoist machine according to the present invention.

Referring now to FIG. 1, there is shown an exploded view of a converter bracket assembly 100 for coupling a two bearing motor 50 onto an integral overhung style elevator hoist machine 60. The assembly 100 comprises an adapter plate 40 for coupling to the face of motor 50. Plate 40 is sized to cover the face of the motor and has a central cavity having an internal diameter sufficient to accommodate motor shaft 52. Plate 40 is preferably bolted to the face of the motor 50 via centrally spaced holes 42. Drum mount flange member 10 is coupled to the hoist machine at a first surface and to a coupling plate at a second surface to reduce vibrations, the drum flange member having a central cavity for receiving the motor shaft. Drum mount flange 10 has a set of pins 12 radially positioned about outer surface 14 of the flange and normal thereto for engaging coupling plate 20. The drum mount flange may also optionally be sized to accommodate a taper lock bushing 70 for securing the flange to the motor shaft.

A second flange member 30 has an interior diameter D for receiving a taper lock bushing 80 sized to the motor shaft.

Flange member 30 has an outer surface on which is formed a set of pins 32, also normal to the outer surface. Coupling plate 20 is coupled between first and second flange members 10 and 30. The coupling plate is preferably made of a resilient material such as a plastic. In a preferred embodiment the coupling plate may be a polydisk, as is known in the art.

Coupling plate 20 has hole portions 22 radially positioned and in alignment with corresponding ones of pin sets 10 and 32, so that each pin in the corresponding pins sets is alternately positioned into corresponding hole portions 22. Coupling plate 20 includes a plurality of spacers or stops 24 positioned on respective front and back surfaces of plate 20 to prevent engagement and contact of flange members 10 and 30 through their respective pins. In a preferred embodiment as shown in FIG. 1, coupling plate 22 comprises ten symmetrically spaced holes, each sized to receive a corresponding pin from one of either the drum mount flange 10 or flange member 30, where both flanges each have five pins formed therein. A set of bolt holes 16 formed through drum mount flange 10 are used to receive corresponding bolts for securing flange 10 to the break drum 62 (see FIG. 3A), which is the furthest most point of the rotating portion of the hoist machine.

Figure 3A:
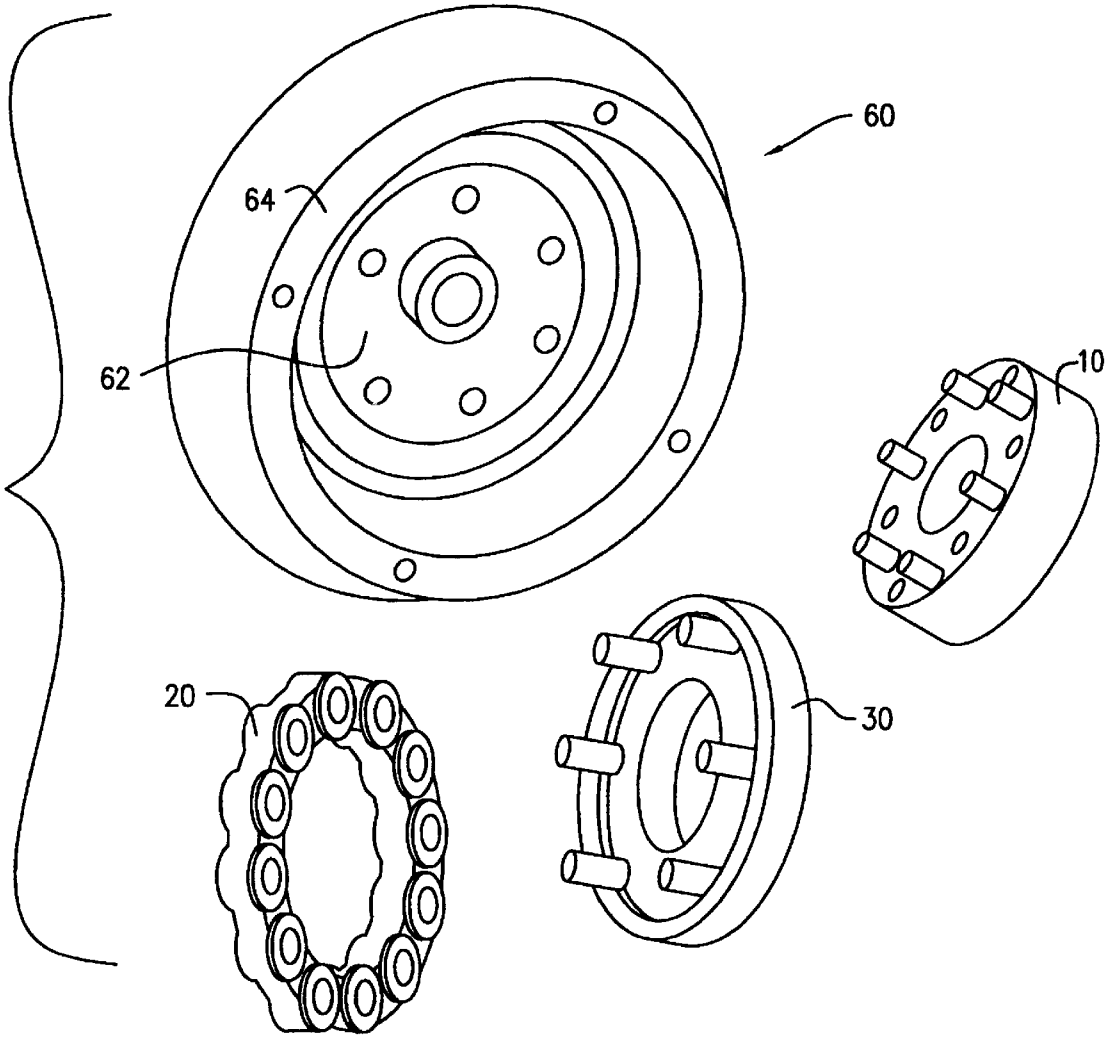
FIGS. 3A–3E illustrate the steps involved in installing the bracket assembly in accordance with the present invention.
Figure 3B:
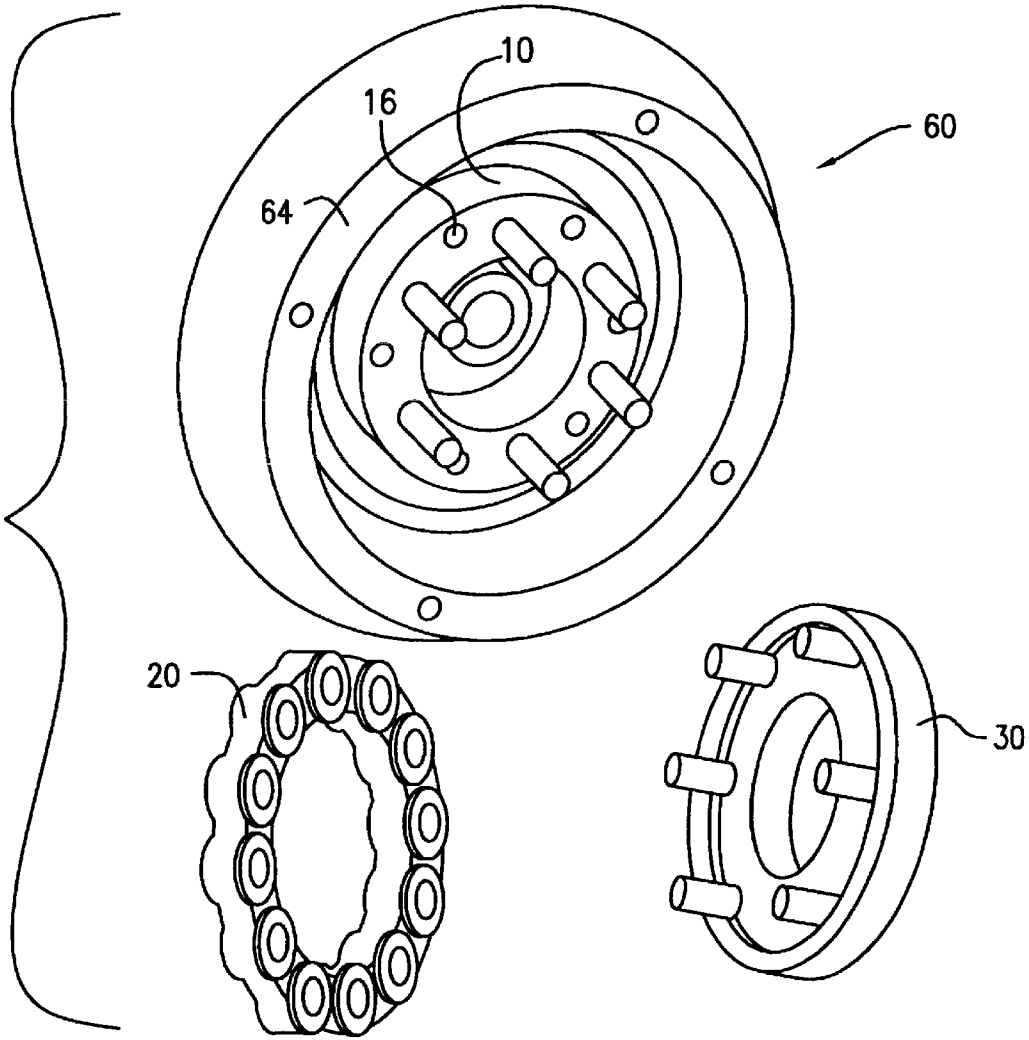
Figure 3C:
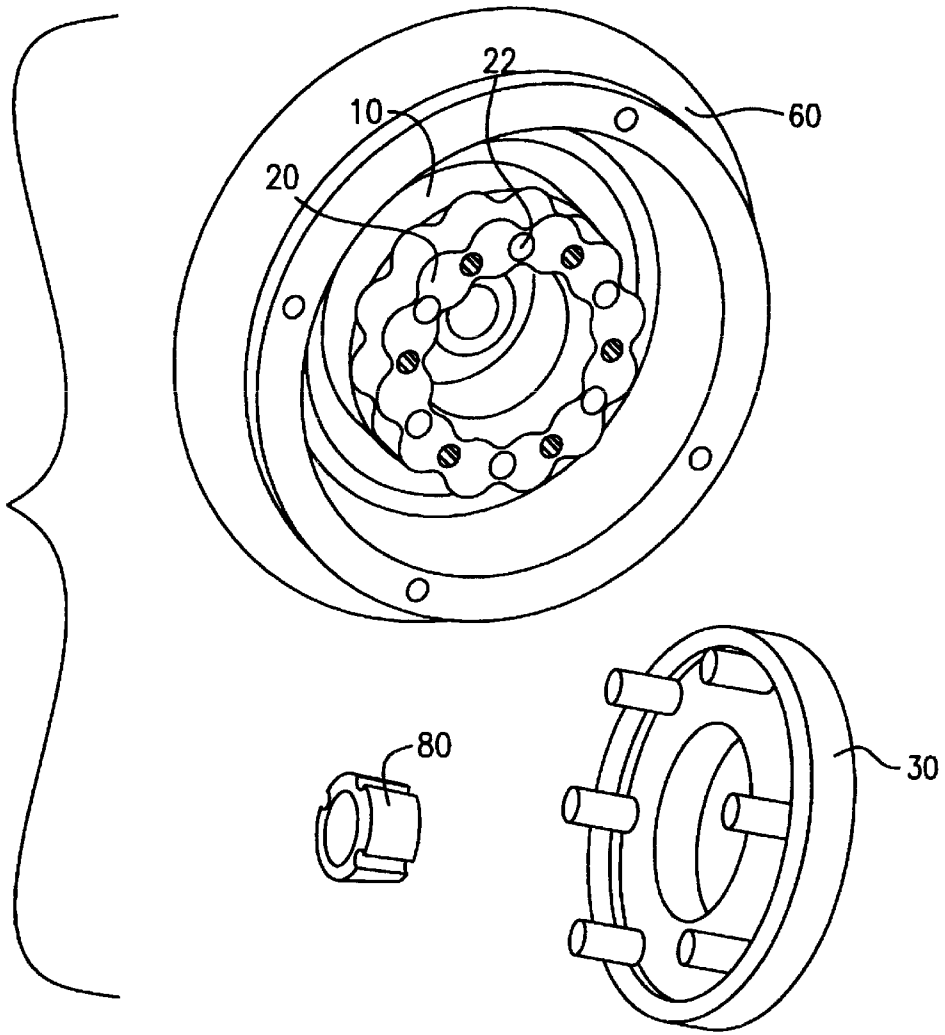
Figure 3D:
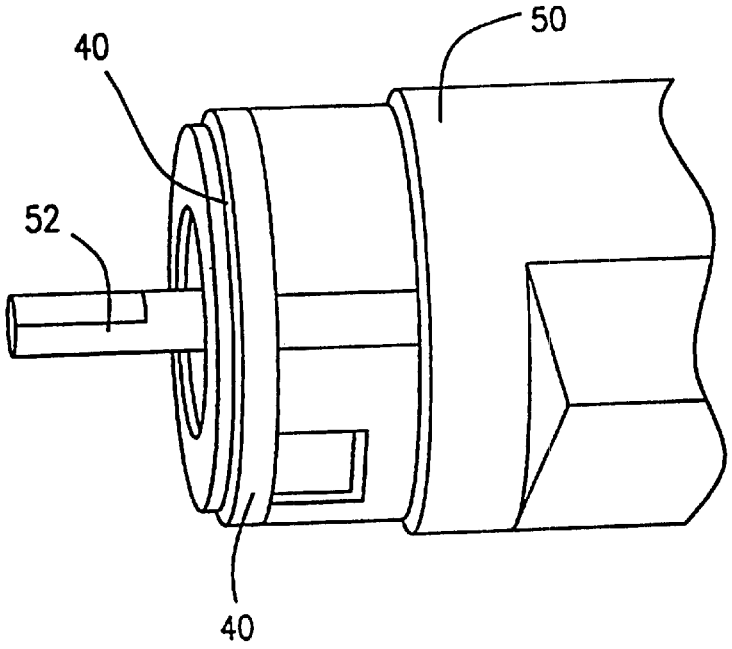
Figure 3E:
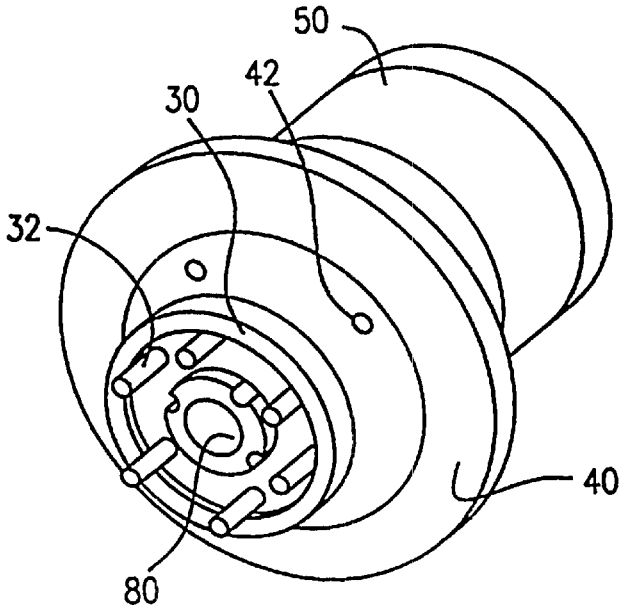

As shown in FIGS. 1 and 3D, motor 40 comprises a C-faced mount motor having four bolt holes machined onto its face. It is intended to be mounted by the face. A D-face motor similarly is intended to be mounted by the face; however the bolt holes are larger on a radius of the shaft. In addition, for D-faced motors, the bolts emanate from the motor side. In a C-faced motor the bolts emanate from the machine side. It is further contemplated that the above converter assembly can be used with foot mounted motors. Note that the outer perimeter or circumference of the flange members and the coupling plate are substantially equal so as to provide a substantially uniform structure. In contrast, the radius or outer circumference of the adapter plate is substantially larger in order to accommodate the size and dimensions of the motor and hoist machine apertures.

In a preferred embodiment, the assembly process is as follows. The adapter plate 40 is applied to the face of motor 40 and bolted thereto. Flange member 30 is then applied to the shaft which receives the flange cavity. The flange is applied in orientation such that pins 32 face away from the motor. Coupling plate 20 is next applied to the motor shaft which receives the coupling plate central cavity and is adapted so that each pin 32 receives a corresponding hole 22. The drum mount flange 10 is then applied to the brake drum of the hoist machine such that pins 12 face away from the hoist machine. The coupling assembly is then aligned and slid about the length of the motor shaft so that the coupling plate engages pins 12 at the remaining corresponding holes formed in the coupling plate until it bottoms out at stops 24. A mark is then made onto the motor shaft at end position 31 of flange 30 for precise positioning and securing of the flange to the motor. Preferably, the motor is slid back out and the bushing assembly is then tightened onto the shaft at the marked position. The motor is then re-applied to the hoist machine and bolted via the adapter plate to securely connect the hoist machine with the motor.

Figure 4:
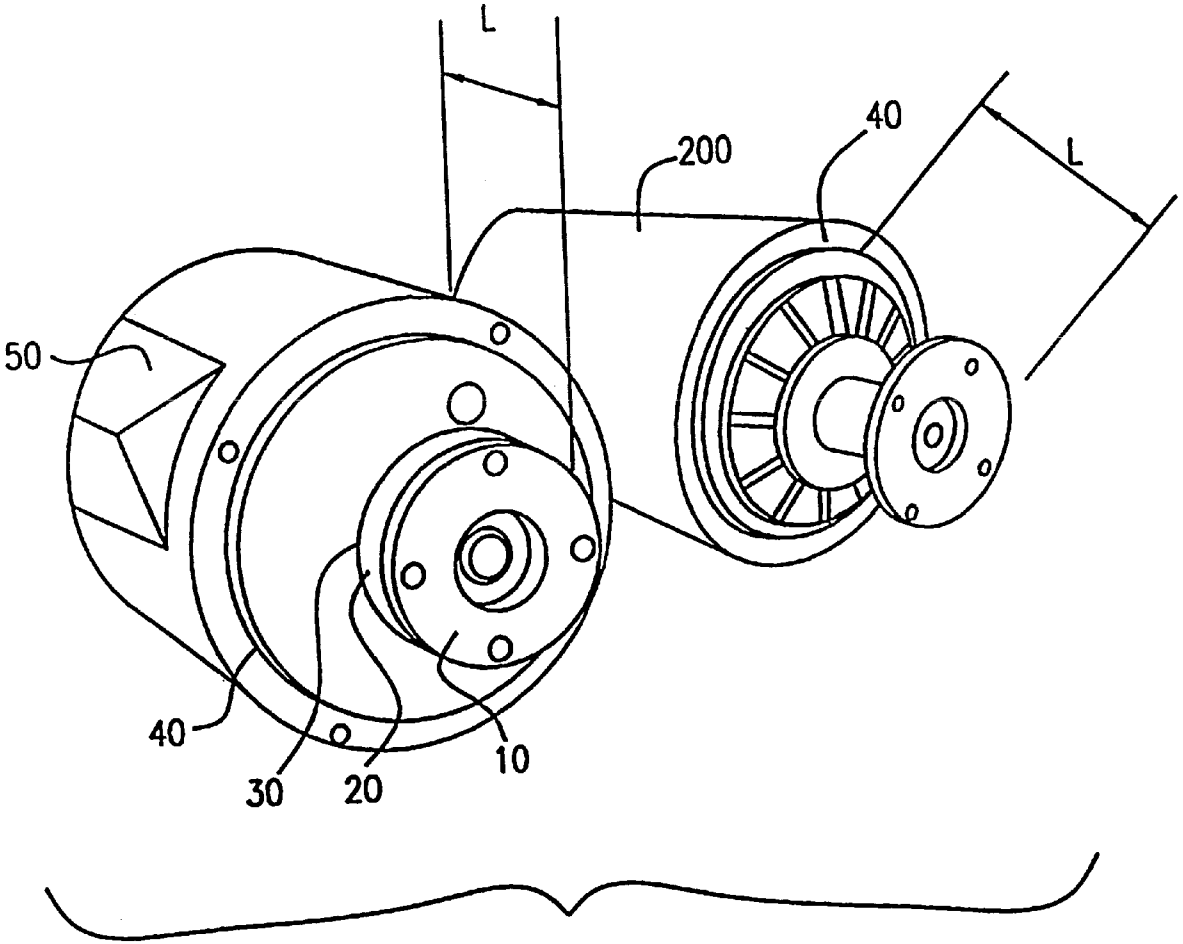
FIG. 4 illustrate the length dimensions associated with placement of the converter assembly onto the shaft of a dual bearing motor in accordance with an aspect of the present invention.

Alternatively, as depicted in FIG. 4, by taking a dimension from where the old single bearing motor 200 was pulled off of the hoist machine, from the top of the adapter 40 to the end of the coupling on the motor to be removed, the appropriate distance L for securing the coupling to the shaft is determined. The distance L is associated with the relative width of the components 10, 20 and 30 for placement onto shaft 52. Note that the accuracy of the placement need only be within ¼ inch, thereby providing a relatively loose tolerance associated with replacing these motors which avoids the end-thrusting problems. Note that spacers 24 within the coupling plate prevent the flange members 10 and 30 to come in contact with one another.

Figure 2A:
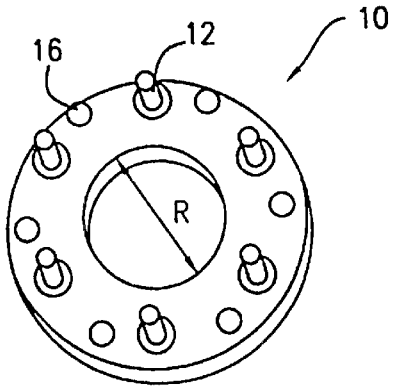
FIGS. 2A and 2B show top and perspective views of the drum flange plate member according to the present invention.
Figure 2B:
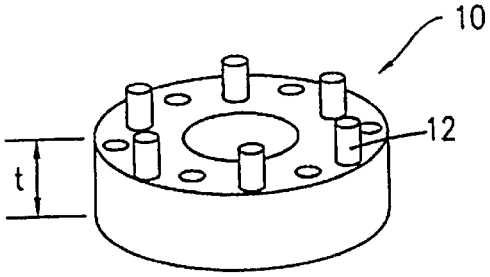

FIGS. 2A and 2B show top and perspective views of drum flange plate member 10. The drum mount flange plate 10 shown in FIGS. 2A and 2B has a set of 6 pins normal to the surface 14 and a cavity of internal diameter R for receiving shaft 52. The diameter of the flange may be adapted to the shaft such that taper lock bushing 70 (see FIG. 1) with set screws 72 are not needed. Holes 16 are arranged in a predetermined pattern about the peripheral portion of the flange and sized to accommodate the bolt size associated with the hoist machine. The size of the diameter R of the flange and the holes 16 are designed to match corresponding pre-existing holes in the brake drum of the hoist machine so as to enable mounting of flange 10 to machine 60. As a consequence the diameter size is usually greater than that of flange 30. The thickness t of the drum mount flange is typically thicker than that of both flange 30 and coupling plate 20 so as to enable use of the factory bolts used in the brake drum. This requires a certain number of inches to accommodate the threads of the factory bolt and shoulders of the bolt. The pins are on the same radius to accommodate the coupling plate (polydisk). The drum mount flange is made of a strong, durable metal such as steel.

Figure 2C:
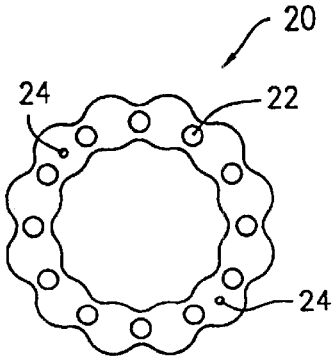
FIGS. 2C and 2D illustrate top and perspective views of the flexible coupling plate according to the present invention.
Figure 2D:
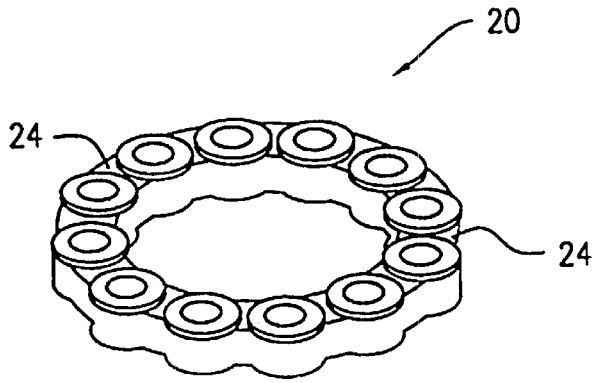
Figure 2E:
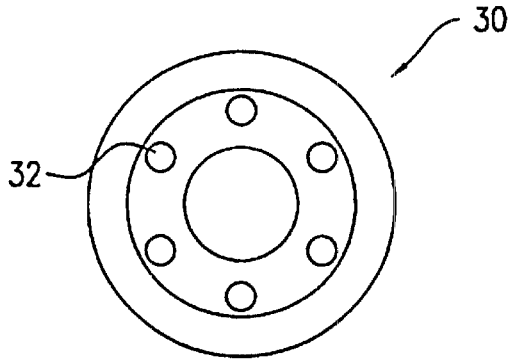
FIGS. 2E and 2F illustrate top and perspective views of the second flange member according to the present invention.
Figure 2F:
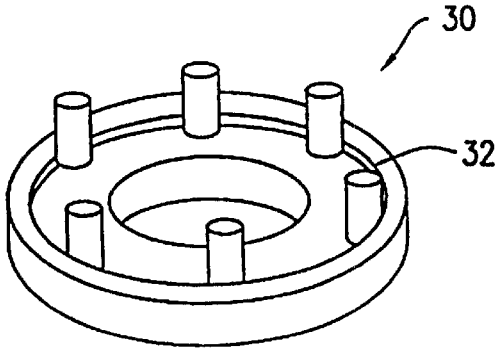

As previously mentioned, flange member 30 is sized to accommodate the shaft and is secured to the shaft via taper lock bushing 80 which is inserted into the interior of the flange member and connected via screws 82. The flange may be of the type H variety part number 008047 as manufactured by DODGE, for example. FIGS. 2E and 2F illustrate top and perspective views of this component part. The taper lock bushing may be sized at 2⅛ inches and of the type manufactured by DODGE as part number 2517.

The flexible coupling plate 20 may be a polydisk of the type also manufactured by DODGE as part number 008035. FIGS. 2C and 2D illustrate top and perspective views of this component part.

Figure 2G:
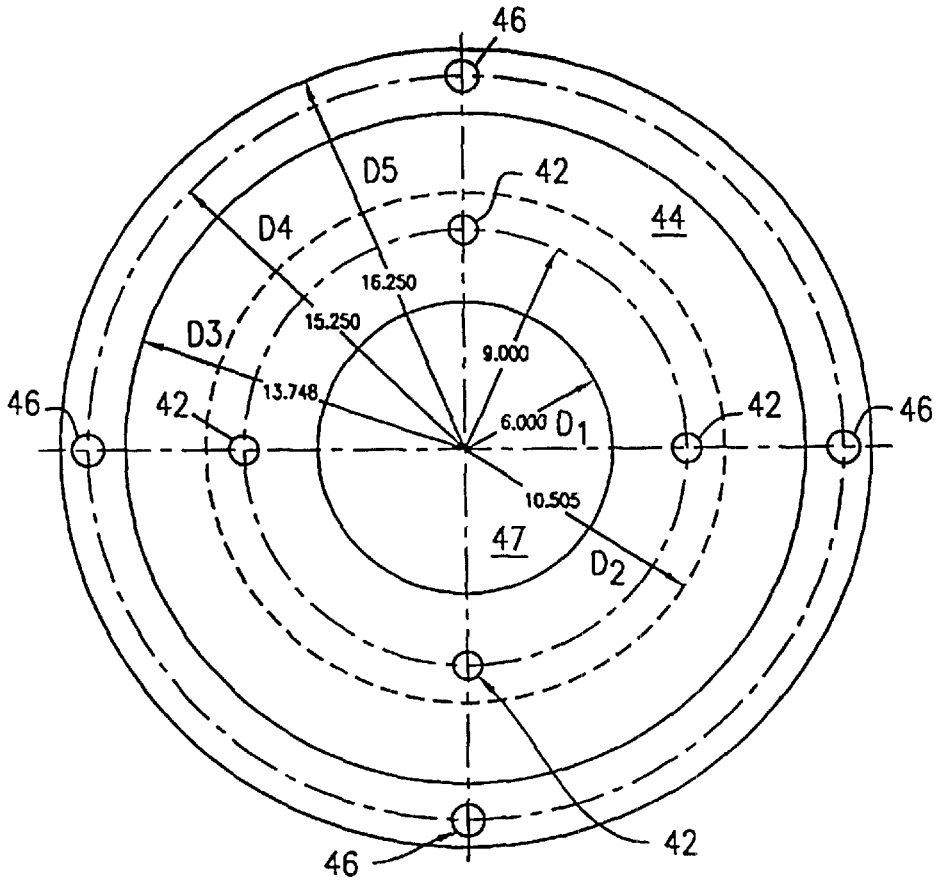
FIGS. 2G and 2H illustrate top and cross-sectional views of the adapter according to the present invention.
Figure 2H:
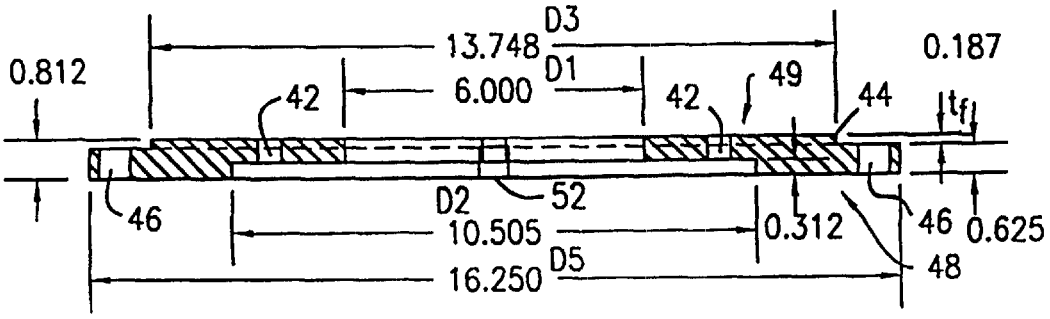

FIGS. 2G and 2H illustrate top and cross sectional views of the adapter plate 40 made of a metal (e.g. steel) and having a first side 48 for coupling to the motor face and a second side 49 adapted for coupling onto the hoist machine. Bolt holes 42 positioned at predetermined locations and equally spaced on the adapter plate have a dimension sized to NEMA standard dimensions such as AK or AJ dimensions for bolting onto the motor 50. Equally spaced bolt holes 46 extending substantially about the circumference of the adapter plate are designed to accommodate connection to the hoist machine. Flange portion 44 extending circularly about an interior portion of side 49 of the adapter plate operates to register the plate to the hoist machine so that the plate engages and fits the specific dimensions associated with the design of the original motor. More particularly, as shown in FIG. 3A, module 60 includes a register 64 which will accommodate and align with the flange 44 of adapter plate 40. The adapter plate also includes central cavity 47 having diameter D1 to accommodate the motor shaft. It is to be understood that the dimensions associated with the flange portion changes according to the motor size and specifications. For example, the flange thickness tf and diameter D3 may change relative to the motor and/or hoist machine to be accommodated. In similar fashion each of the other designated diameters may also be modified depending on the particular application. The values provided in FIGS. 2G and 2H are merely exemplary for a particular application.

FIGS. 3*a*–3C depict the preferred method of assembling the dual bearing motor 50 to the integral overhung hoist machine 60. Referring now to FIG. 3A, The existing motor is first removed from the hoist machine. The bolts may be kept for reuse if in good condition. As shown in FIG. 3B and as described above, the drum mount flange 10 is then mounted to the brake drum 62 and secured via bolts inserted into corresponding bolt holes 16. The coupling plate 20 or polydisk is then placed onto the pins 12 of flange 10 through corresponding holes 22 as shown in FIG. 3C. The adapter plate is then bolted onto the face of the motor 50, as depicted in FIG. 3D. The flange 30 is then mounted with the taper lock bushing 80 loosely onto shaft 52. The motor 50 is then applied to the hoist machine 60 and pins 32 are inserted completely into the coupling plate with the motor flush against the machine face (not shown). The shaft 52 is then marked to determine where the coupling assembly will remain fixed. The motor is then removed and screws 82 are tightened on the taper lock bushing 80 to fixedly secure flange 30 to the shaft. The motor 50 is then reapplied to the hoist machine and bolted thereto via bolts inserted into holes 46 on the adapter plate 40.

As one can ascertain from the above discussion, the installation process is very efficient and a new dual bearing motor may be installed within approximately one hour, where the only parts used from the prior coupling or motor arrangement are the bolts. Attempts to use existing couplings result in significant problems and limitations, including taking the assembly to a machine shop, fitting to a new motor, and using a lathe to "true up" the assembly. The expense of labor and machining alone exceeds the cost of the present invention assembly and fails to address the motor bearing loading problems corrected by the above assembly. In this manner, vibration and noise are significantly reduced and motor life is extended because of the present fit and design of the assembly. In addition, the assembly allows maintenance and future motor repair to be conducted quickly and easily with the removal of only four bolts.

While the foregoing invention has been described with reference to the above embodiments, various modifications and changes can be made without departing from the spirit of the invention. Foe example, the size and the dimensions described herein for the component parts may be adjusted according to the requirements and size of the motor, as is known by those skilled in the art. Accordingly, all such modifications and changes are considered to be within the scope of the appended claims.

I claim:

1. An adapter plate for mounting a motor housing to a machine housing, said adapter plate having:

a central opening for receiving a drive shaft of said motor;

an inner surface shaped to engage a front surface of said motor; and an outer surface opposite said inner surface shaped to engage a front surface of a hoist machine housing, said adapter plate including a plurality of apertures for receiving fasteners for fastening to said front surface of said motor and said front surface of said hoist machine housing.

2. The adapter plate of claim 1, wherein said plurality of apertures includes a first set of through holes for receiving a first set of said fasteners for coupling the adapter plate to said motor.

3. The adapter plate of claim 2, wherein said plurality of apertures further includes a second set of through holes for receiving a second set of said fasteners for coupling the adapter plate to said hoist machine.

4. The adapter plate of claim 3, wherein said second set of through holes extend radially from said first set of through holes.

5. The adapter plate of claim 1, wherein said inner surface is adapted for engaging a NEMA standard motor.

6. The adapter plate of claim 5, wherein said NEMA standard motor is a C-faced motor.

7. The adapter plate of claim 5, wherein said NEMA standard motor is a D-faced motor.

8. The adapter plate of claim 1, wherein said inner surface includes a flanged portion for fittingly engaging a corresponding portion of said front surface of said motor.

9. The adapter plate of claim 1, wherein the outer surface has a flanged portion for fittingly engaging a corresponding shoulder of said front surface of said hoist machine.

10. The adapter plate of claim 1, wherein said inner surface of said adapter plate includes an annular planar surface extending radially from a central recessed portion defining a stepped member, wherein a subset of said plurality of apertures for receiving fasteners are formed within said recessed portion for fastening to said front surface of said motor.

11. The adapter plate of claim 1, wherein said outer surface of said adapter plate includes a first annular planar surface extending radially from a central raised planar surface defining a stepped member, wherein a subset of said plurality of apertures for receiving fasteners are formed within said central raised planar surface for fastening to said front surface of said hoist machine.

12. The adapter plate of claim 1, wherein said plurality of apertures comprise a first set of apertures alignable with a corresponding first set of apertures in said front surface of said motor for coupling said adapter plate to said motor; and a second set of apertures alignable with a corresponding second set of apertures in said front surface of said hoist machine for coupling said adapter plate to said hoist machine.

13. The adapter plate of claim 12, wherein said first set of apertures are equally spaced from one another about said adapter plate, and wherein said second set of apertures are equally spaced from one another about said adapter plate.

14. A method for mounting a motor housing to a hoist machine housing comprising:

providing an adapter plate having a central opening for receiving a drive shaft of said motor, an inner surface shaped to engage a front surface of said motor; an outer surface opposite said inner surface shaped to engage a front surface of said hoist machine, forming a plurality of apertures in said adapter plate; and fastening said adapter plate to said front surface of said motor and to said front surface of said hoist machine via said plurality of apertures.

15. The method of claim 14, wherein the step of forming said plurality of apertures comprises:

forming a first set of apertures about said adapter plate;

forming a second set of apertures about said adapter plate; and aligning said first set of apertures with a corresponding first set of apertures in said motor, and said second set of apertures with a corresponding second set of apertures in said hoist machine for coupling to said motor and said hoist machine via said first and second sets of apertures.

16. The method of claim 14, wherein the step of fastening comprises:

inserting a first set of fasteners into said first set of apertures for fastening to said motor; and inserting a second set of fasteners into said second set of apertures for fastening to said hoist machine.

17. The method of claim 16, wherein the step of providing an adapter plate comprises:

forming in said inner surface of said adapter plate an annular planar surface extending radially from a central recessed portion defining a stepped member; and forming a subset of said plurality of apertures within said recessed portion for fastening to said front surface of said motor.

18. The method of claim 17, wherein the step of providing an adapter plate further comprises:

forming in said outer surface of said adapter plate a first annular planar surface extending radially from a central raised planar surface defining a stepped member; and forming a subset of said plurality of apertures within said central raised planar surface for fastening to said front surface of said hoist machine.

19. The method of claim 14, wherein the step of providing an adapter plate further comprises adapting the inner surface of said plate for engaging a NEMA standard motor.

20. The method of claim 19, wherein said NEMA standard motor is a C-faced or D-faced motor.

* * * * *

UNITED STATES PATENT AND TRADEMARK OFFICE

CERTIFICATE OF CORRECTION

PATENT NO. : 6,578,674 B2
DATED : June 17, 2003
INVENTOR(S) : Paul J. Doran

It is certified that error appears in the above-identified patent and that said Letters Patent is hereby corrected as shown below:

Title page,
Item [54], Title, please correct the title to read:
-- ADAPTER PLATE FOR MOUNTING A MOTOR HOUSING TO A HOIST MACHINE HOUSING --

Signed and Sealed this

Twenty-third Day of December, 2003

JAMES E. ROGAN
*Director of the United States Patent and Trademark Office*